United States Patent [19]

Rigollet

[11] Patent Number: 5,017,940

[45] Date of Patent: May 21, 1991

[54] ELECTROMAGNETIC WAVE REFLECTOR FOR AN ANTENNA AND ITS PRODUCTION METHOD

[75] Inventor: Jean-Paul Rigollet, Paris, France

[73] Assignee: Aerospatiale Societe Nationale Industrielle, Paris, France

[21] Appl. No.: 452,776

[22] Filed: Dec. 19, 1989

[30] Foreign Application Priority Data

Dec. 21, 1988 [FR] France ..... 88 16916

[51] Int. Cl.[5] ..... H01Q 15/14

[52] U.S. Cl. ..... 343/912; 343/897; 29/600

[58] Field of Search ..... 343/912, 897; 29/600; 66/232

[56] References Cited

U.S. PATENT DOCUMENTS

| | | | |
|---|---|---|---|
| 2,742,387 | 4/1956 | Giuliani | 343/912 |
| 2,972,743 | 2/1961 | Svensson et al. | 343/838 |
| 3,483,614 | 12/1969 | Kazimi | 29/600 |
| 3,694,058 | 9/1972 | Shakespeare | 343/912 |
| 3,716,869 | 2/1973 | Gould, Jr. et al. | 343/912 |
| 4,479,131 | 10/1984 | Rogers | 343/872 |
| 4,710,777 | 12/1987 | Halverson | 343/912 |
| 4,812,854 | 3/1989 | Boan et al. | 343/912 |

FOREIGN PATENT DOCUMENTS 59-211303 11/1984 Japan ..... 343/912

OTHER PUBLICATIONS

FR-A-2 598 339 (Agence Spatiale Europeenne) FIGS. 1, 5; p. 2, ligne 10-p. 3, ligne 35; p. 9, ligne 17-p. 10, ligne 31.

Globecom'85-IEEE Global Telecommunications Conference, New Orleans, La., 2-5 Dec. 1985, vol. 1, pp. 412-416, IEEE, New York, U.S.; P. Bielli et al.: "Dichroic Subreflectors for Multifrequency Antennas".

*Primary Examiner*—Michael C. Wimer
*Assistant Examiner*—Hoanganh Le
*Attorney, Agent, or Firm*—Hayes, Soloway, Hennessey & Hage

[57] ABSTRACT

The invention is an electromagnetic wave reflector for an antenna and its production method. The wave reflector comprises a rigid curved support provided with a convex front face coated with a heat-insulating paint, a metal fabric suitable for reflecting the electromagnetic waves and covering the paint, hook and loop strip type fixing means secured to the rear face of the support ensuring that the fabric is maintained on the support, and a thermal extra-insulating material situated on the entire rear face of the support, said extra-insulation material being kept in place by adhesive polyimide strips.

9 Claims, 4 Drawing Sheets

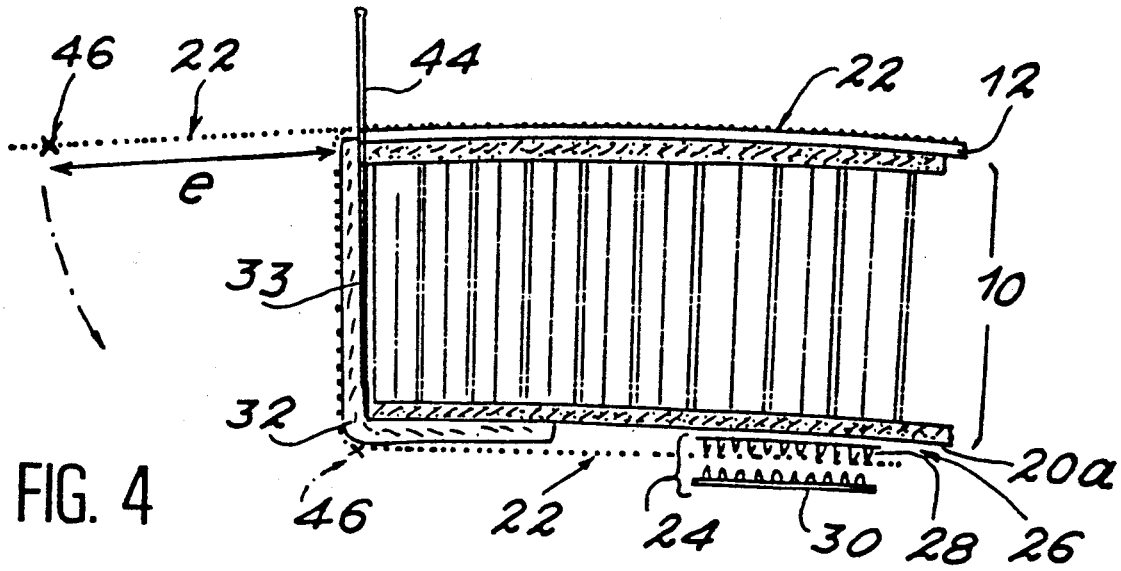
FIG. 4
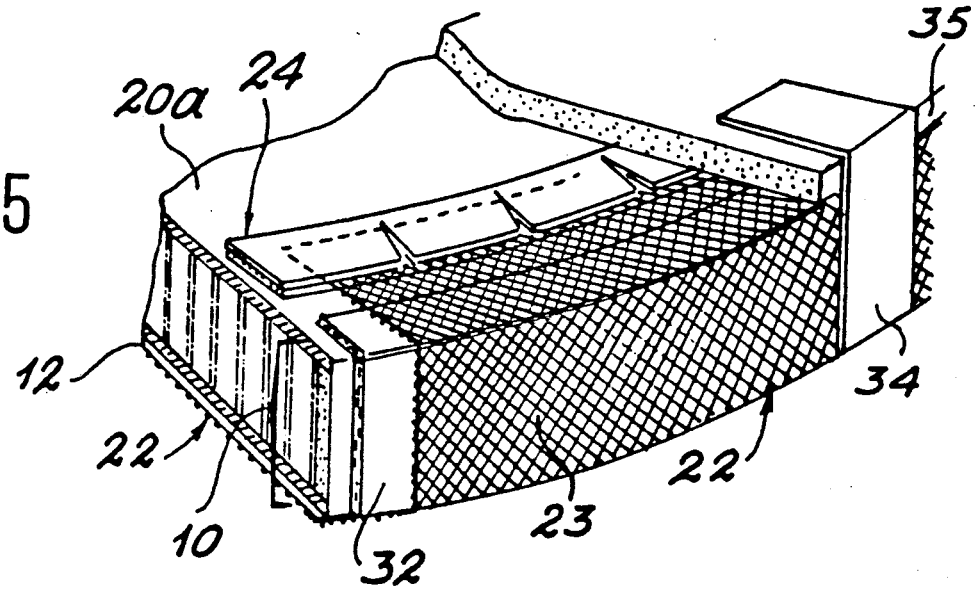
FIG. 5
FIG. 6
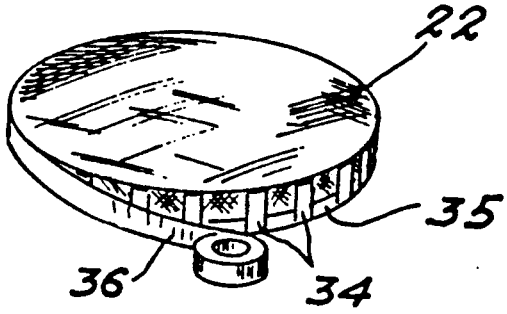

ELECTROMAGNETIC WAVE REFLECTOR FOR AN ANTENNA AND ITS PRODUCTION METHOD

BACKGROUND OF THE INVENTION

1. Field of the Invention

The object of the invention is to provide an electromagnetic wave reflector with a convex surface and also concerns its production method. More specifically, this reflector constitutes the secondary reflector of a radio antenna with a "Cassegrain" type configuration, said reflector designed to function in a wavelength range extending up to 20 GHz.

2. Description of the Prior Art

In particular, these antennae are used in the field of telecommunications and may be used on land or in space. As regards spatial applications, these antennae are designed to equip telecommunications satellites.

Although the reflector of the invention is more particularly designed to constitute the secondary reflector of a "Cassegrain" type antenna, it may also be used as a reflector in a conventional single-reflective antenna or as the main reflector in a double-reflective antenna.

To help distinguish the invention from the prior art, the following figures are referenced:

FIG. 1 Cassegrain type antenna arrangement; and

FIG. 2 sectional view of antenna reflector.

An antenna with a conventional configuration is composed of a radiofrequency source and a reflector with a parabolic form whose concave face usually constitutes the active face. The source is placed at the focal point of the reflector and is designed to emit or receive electromagnetic radiation focalized by the reflector.

In certain arrays and more particularly in the space field, a secondary reflective antenna is preferably used having a "Cassegrain" type configuration so as to limit the spatial requirement of the antenna for a given focal distance (usually from 1 to 3 m). FIG. 1 diagrammatically shows a "Cassegrain" type antenna.

This antenna mainly comprises a reflector or principal mirror 2 which is a focal point paraboloid $F^1$, a reflector or secondary mirror 4 whose surface is a focal point hyperboloid type surface $F^2$ and a primary source 6 placed in the focal point $F^2$.

For transmission functioning, the source 6 illuminates the secondary reflector 4 which reflects the radiation 7 onto the principal reflector 2, the latter ensuring the directivity of emission of the electromagnetic radiation.

In receiving, functioning is effected in the opposite direction: receiving of the electromagnetic waves by the principal mirror 2 which reflects these towards the secondary mirror 4 where they are again reflected towards the source 6.

The configuration represented on FIG. 1 is an "Offset" or "moved out of center" type configuration. The functioning of a "centered" type antenna is almost the same.

In spatial applications, the active face of the antenna reflectors, namely respectively the reflecting faces 4*a* and 2*a* of the principal 4 and secondary 2 mirrors, are covered with a silicon-based paint, usually white. The aim of this paint is to protect the reflectors mounted on satellites from any cyclic thermal variations caused by the alternating passages of shadow zones and solar illumination zones.

This thermal protection makes it possible to minimize any resultant thermoelastic deformations of the reflector by keeping the active faces 4*a* and 2*a* within a range of profiles, which retains the desired radioelectric performances of the antenna.

Although this paint provides a generally satisfactory thermal insulation, in certain cases it does have a number of drawbacks. These are accounted for by the fact that the incident radiation traverses the paint layer before being reflected onto the conductive surface 4*a* or 2*a* of the reflector.

In the case of a circular polarization electromagnetic wave, the paint layer provokes a phase shift between the components of the vertical and horizontal electric field. This phase shift destroys the purity of the circular polarization and the reflected radiation then exhibits an elliptic polarization corresponding to a loss of energy. This phenomenon is much more significant when the angle of incidence i (FIG. 1) made by the radiation with respect to normal at the active surface is high.

For small angles, this usually being the case in antennae with a single reflector, the effect of this phase shift cannot be taken into account. On the other hand, these disturbances are quite significant in the case of secondary reflectors "Cassegrain" type antennae and more particularly those with a "moved out of center" configuration where the angles of incidence of radiation may reach high values (about 60°) on the secondary reflector.

Furthermore, as regards spatial applications, the antenna reflectors need to be as light as possible so as to facilitate the placing in orbit of a satellite equipped with these reflectors.

In order to overcome these drawbacks, an antenna reflector with a convex active face has recently been designed, as diagrammatically shown on FIG. 2. This antenna reflector 4 comprises a rigid support 10 whose active face 10*a* is entirely coated with the paint 12 containing a heat insulating material. This insulating layer 12 is itself covered with a metallized coating 14. In particular, this coating 14 is a polyimide film, such as (Kapton$^{200}$), with a thickness of 25 micrometers, covered with a 30 to 40 nm layer of aluminum.

This coating 14 is relatively light and ensures reflection of the electromagnetic waves 7, as can be clearly seen on FIG. 2, and thus prevents electromagnetic radiation from traversing the paint layer 12 and accordingly its change of polarization.

So as to ensure a minimum weight of the reflector, the rigid support 10 is formed by a rigid honeycomb-shaped structure sandwiched between two carbon coatings 18 and 20.

The reflector of FIG. 2 makes it possible to clearly overcome these previously mentioned drawbacks.

Unfortunately, the use of an aluminized (Kapton®) coating 14 has a certain number of drawbacks. In fact, this type of material is difficult to produce as it needs to be formed with a precise mechanical tension so as to absorb the volume expansions of the support 10 in a cycle of temperatures normally ranging from −160° C. to +100° C. where a satellite antenna is placed into orbit, whilst ensuring a proper reflection of the waves.

In addition, this coating is difficult to implement and may possibly tear or crack. Finally, this coating is slightly ductile, which limits its use. In particular, this material cannot be used for reflectors with extremely high convexity.

SUMMARY OF THE INVENTION

The precise object of the present invention is to provide an electromagnetic wave reflector constituting in particular the secondary reflector of a radio antenna with two reflectors making it possible to overcome the above-mentioned drawbacks. In particular, this reflector comprises a solid wave reflective material able to be used regardless of the convexity of the reflector and absorbing all the thermal expansions of the support of the reflector whilst preventing any change of polarization of the electromagnetic radiation when a heat insulating paint is used.

Furthermore, owing to its light weight, the reflector of the invention may be used in spatial applications.

Thus, the object of the invention is to provide a convex electromagnetic wave reflector with a wavelength $\lambda$ and comprising a curved rigid support and provided with a convex front face constituting the active face of the reflector and with a rear face, a heat insulating and dielectric paint coating the active face, a taut electric conductive fabric suitable for reflecting said wave and covering the insulating paint, the mesh of the fabric having a diameter of less than $\lambda/8$, and means to secure the fabric to the support.

The conductive fabric of the invention can be easily adapted to non-extractable forms with high convexity, contrary to the case with aluminized polyimide of the prior Art.

In addition, with a heat insulating material, such as a silicon-based paint, fully coating the active face of the reflector, this fabric ensuring the reflection of electromagnetic waves prevents the latter from traversing the sub-jacent layer of paint and consequently their change of polarization.

According to the invention, the fabric may be embodied with any material which is a good conductor of electricity and having a low coefficient of expansion. This fabric may be made of platinum, silver, titanium, gold, molybdenum, tungsten or a metal alloy. Preferably, molybdenum is used covered with a film of gold, molybdenum being the metal associating the best coefficient of expansion ($5.10^{-6}$ m/m° C.) with one of the least highest electric resistivities ($5.2.10^{-6}$ $\Omega$.cm). Furthermore, it possesses a low specific mass (9 g/cm3), this being extremely advantageous for spatial applications. The film of gold covering the molybdenum improves the metallic contacts.

Furthermore, the fabric is extremely light, this aim being desired for a reflector designed to equip an antenna placed on a satellite. In this particular case, a rigid support is preferably used, said support being constituted by a honeycomb structure sandwiched between a first coating constituting the front face of the reflector and a second coating constituting the rear face of said reflector.

The honeycomb structure may be made of metal, glass, (Kevlar®) or of carbon. In addition, the coatings situated on both sides of the honeycomb structure may be made of carbon, (Kevlar®) or glass.

So as to improve the heat insulation of the reflector, additional heat insulating means are provided on the entire rear face of the reflector. These means may be constituted by a single layer of insulating paint or a stacking of metallized layers and insulating layers. Preferably, a stacking of layers of metallized polyimide and fabric gauzes is used.

Although any fixing device may be used to render integral the conductive fabric and the rigid support, it is preferable to use one or more adhesive strips mounted integrally on the rear face or on the edge of the support, or even on both at the same time. Preferably, an adhesive strip is used mounted integrally on the rear face of the reflector constituted by a first section provided with pins or hooks and by a second section intended to adhere to the first section, generally known as a felt section, the circumference of the fabric being inserted between these two sections.

The object of the invention is to also provide an antenna with a convex secondary reflector embodied as described earlier. This antenna is in particular a "Cassegrain" type antenna with a "centered" or "moved out of center" configuration.

The object of the invention is further to provide a method to produce an electromagnetic wave reflector of the type described earlier and comprised of:

(1) mounting on the rear face of the reflector means to secure the fabric to the support, (2) placing on the active painted face of the reflector a section of fabric larger than the section of the active face, (3) stretching said fabric to the desired tension, (4) implanting needles into the stretched fabric at the periphery of the support, (5) overcasting the stretched fabric at a specific distance from the needles and outside the support, (6) folding down the non-overcast section of the fabric onto the rear face of the support, (7) securing said non-overcast section to the rear face of the reflector with the aid of said fixing means, and (8) removing said needles.

Other characteristics and advantages of the invention shall appear more readily from a reading of the following description, given by way of illustration and being in no way restrictive, with reference to the accompanying FIGS. 3 to 8, FIGS. 1 and 2 having already been described.

BRIEF DESCRIPTION OF THE DRAWINGS

FIG. 4 represents one enlarged view of the reflector of the invention illustrating the securing of the fabric to the active face;

FIG. 5 illustrates the additional heat insulation means of a reflector according to the invention;

FIG. 6 illustrates maintaining the fixing of heat insulation.

DETAILED DESCRIPTION OF THE PREFERRED EMBODIMENTS

Figure 1:
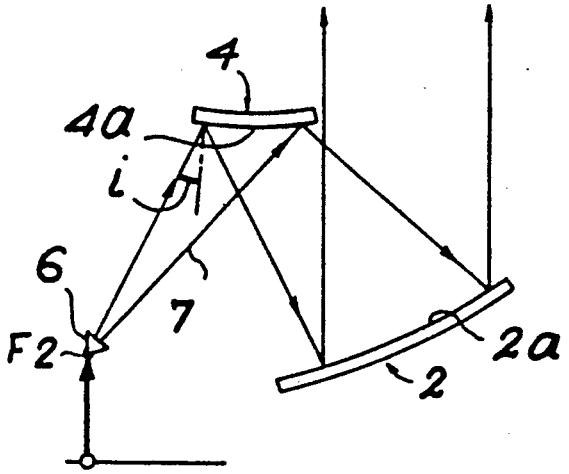
FIG. 1 illustrates a Cassegrain type antenna arrangement.

The description which follows refers to a secondary convex reflector of a "Cassegrain" type antenna (see FIG. 1), although, as can be seen earlier, the invention has a much more general application. Furthermore, the elements of the reflector, which are common to those of the prior Art, bear the same references.

Figure 3:
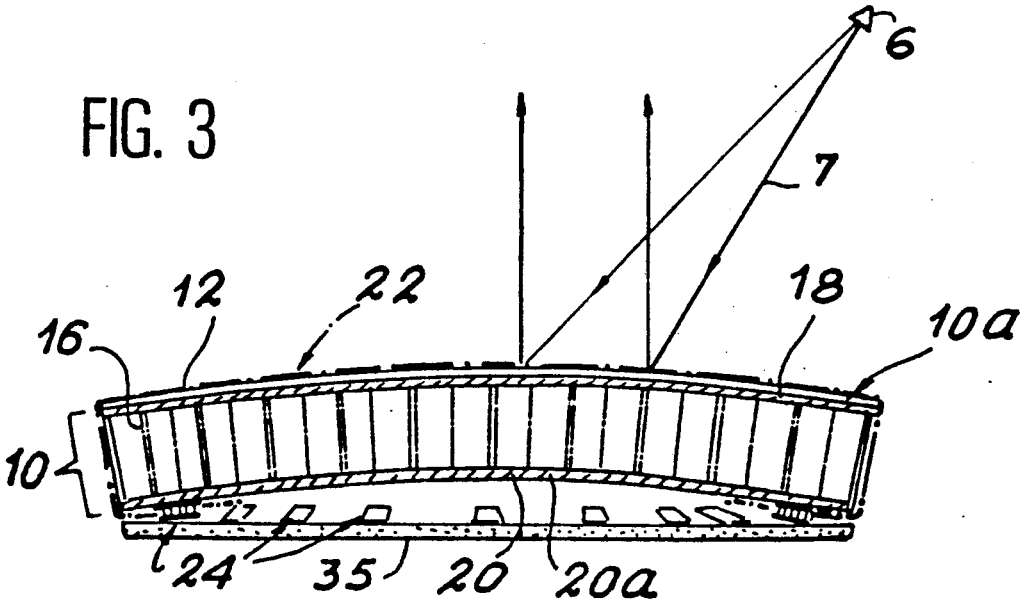
FIG. 3 diagrammatically represents a view of the entire reflector of the invention.

With reference to FIGS. 3, 4 and 5, the electromagnetic wave reflector of the invention comprises a rigid convex support 10 with an elliptic contour and constituted by an aluminum honeycomb-shaped structure 16 sandwiched between an upper carbon coating 18 and a lower carbon coating 20. The support 10 has a total thickness of about 25 mm for an elliptic-shaped reflector with a major axis of 500 mm and a minor axis of 350 mm.

The upper face 10*a* of the support constituting the active face of the reflector is equipped with a silicon-based layer of paint 12, such as the paint (PSG 120 FD) manufactured by (Astral). This paint has the advantage of having fully satisfactory thermo-optical characteristics for thermal protection of the support 10. In fact, the solar absorbance (or absorption coefficient) of this paint is less than 0.2.

This layer of paint 12 completely covers the upper face 10*a* of the rigid structure; it has a thickness of about 0.1 mm, which corresponds to a weight of 260 g/m2.

According to the invention, a metal fabric 22 fully covers the insulating paint 12. The mesh of this fabric depends on the frequency of the radioelectric radiation to be reflected. In order that the fabric reflects a wave of wavelength $\lambda$, this requires that the size or "diameter" of the mesh 23 (FIG. 5) is $<$ than $\lambda/8$. For example, a mesh 2 mm in diameter is used for a radio frequency of $\leqq 2$ GHz and a mesh of 1 mm for a radio frequency of $\leqq 15$ GHz.

In particular, this fabric is constituted by gold-plated molybdenum threads 25 micrometers thick and is sold by the Brochier company (France).

As shown on FIG. 3, this fabric 22 ensures the reflection of the electromagnetic waves 7 derived in particular from a radiofrequency source 6. The reflection of the waves onto the fabric 22 does not in any way modify the properties (and in particular polarization) of the wave received.

Securing of the fabric 22 to the support 10 is ensured in particular by a "Velcro®" hook and loop type adhesive strip 24 situated on the rear face 20*a* of the reflector and at its periphery. To this effect, the fabric 22 is required to have dimensions large than those of the surface 10*a* of the reflector so as to be turned down under the rear face 20*a* of the reflector.

As represented on FIG. 4, hook and loop strip is constituted in a known way by a section 26 equipped with pins or hooks 28 and a felt section 30 designed to adhere to the pins of the section 26, the fabric 22 being kept in place by placing the extremity of the latter between the two sections 26 and 30; the pins 28 ensuring fixing of the felt section 30 penetrate the fabric 22.

The back of the section 26 of the hook and loop strip is rendered integral with the lower face 20*a* of the reflector with the aid of an epoxy-modified cold bonding type agent known under the brand "REDUX 408".

The hook and loop strip 24 is in particular situated 10 mm from the periphery of the support 10 of the reflector.

When the hook and loop strip used appears in the form of a continuous rectilinear strip, it is necessary to regularly indent it according to the bending radius of the reflector (about every 30 to 60 mm) so as to align it as precisely as possible with respect to the periphery of the reflector.

So as to improve finishing of the support 10 and to protect it from surrounding pollution, an adhesive polyimide film 32 is positioned by gluing it onto the entire edge 33 of the support 10 and onto the periphery of the rear face 20*a* of the reflector. This adhesive film 32 is placed between the support 10 and the fabric 22 and is disposed so as to trim flush the layer of paint 12.

Figure 9:
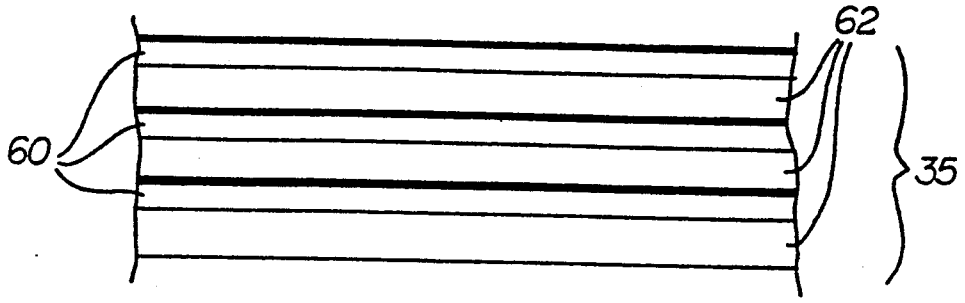
FIG. 9 is a side view illustrating details of additional heat insulation means according to the invention.

So as to improve the heat insulation of the reflector, an additional heat insulation material 35 may be provided on the entire rear face 20*a* of the reflector, as shown on FIGS. 3, 5 and 6. This extra-heat insulation is in particular constituted by a stacking of layers 60 of aluminized or gold-plated polyimide and fabric gauzes 62 made of nylon or glass as shown in FIG. 9. This insulation is extremely light. Its precise structure and production are well-known to experts in this field, The polyimide used is "Kapton®".

As represented on FIGS. 5 and 6, adhesive polyimide strips 34, said adhesive being, for example, "Kapton®" *adhesive, ensure holding down of the heat insulation material* 35. *These strips are spaced* 20 mm apart, for example, and have a width of 10 mm. They are glued onto the fabric 22 and the extra-heat insulation material so as to cover the edge 33 of the reflector and the periphery of the rear face 20*a*.

Figure 2:
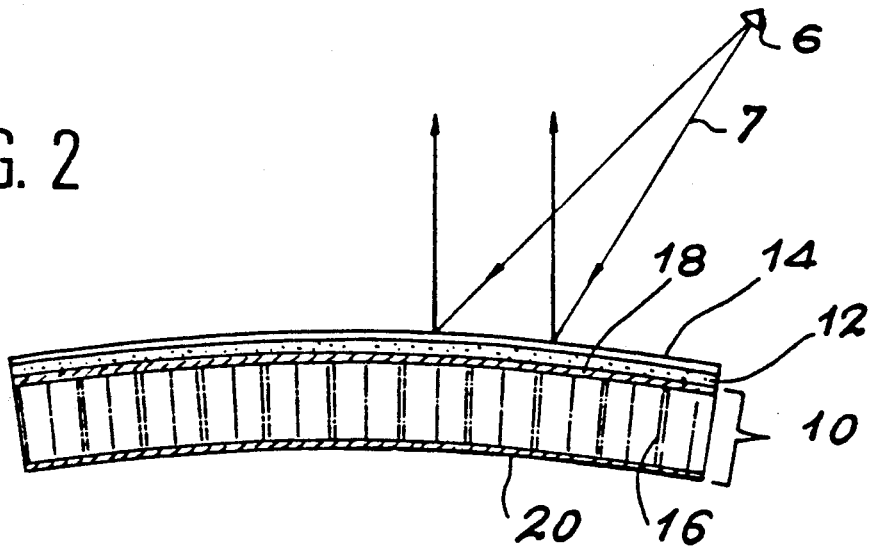
FIG. 2 illustrates a sectional view of antenna reflector.

Contrary to the case with the prior Art (FIG. 2), the "Kapton®" used does not need to be stretched; the requirements of the "Katpon®" in the invention are not the same as those of the prior Art since it is not used to reflect the electromagnetic waves, this function being provided by the fabric.

So as to avoid any possible ungluing of the strips 34 glued onto the fabric, an adhesive hoop 36 can be placed on the edge of the reflector so as to completely surround the reflector (FIG. 6). This hoop is an adhesive polyimide and in particular is adhesive "Kapton®".

Figure 7:
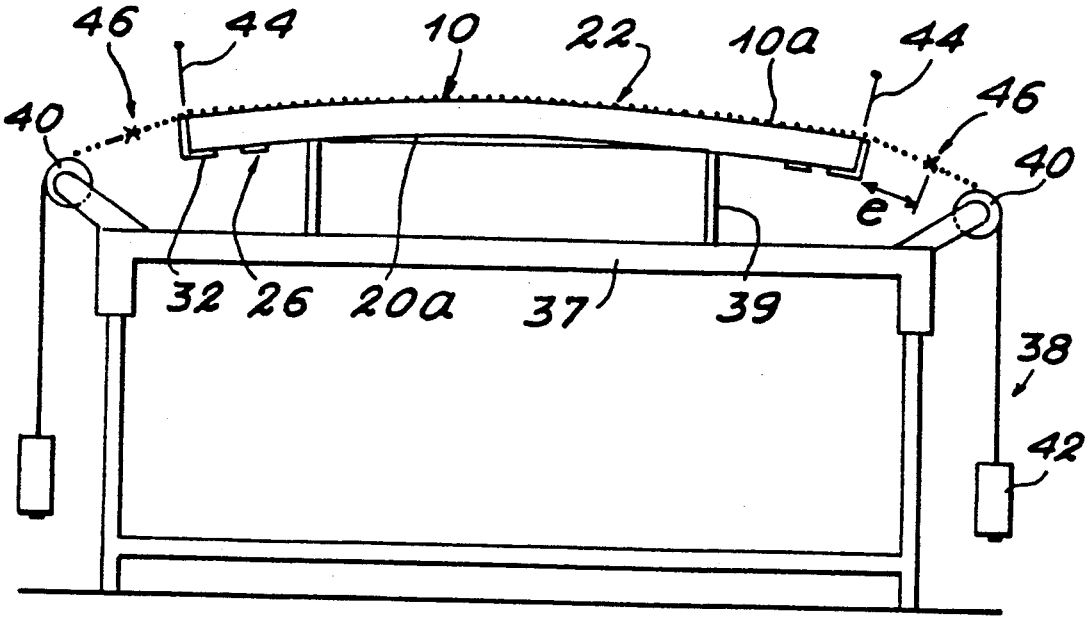
FIG. 7 is elevation view diagrammatically illustrating the mounting of the fabric onto the support of the reflector of the invention.
Figure 8:
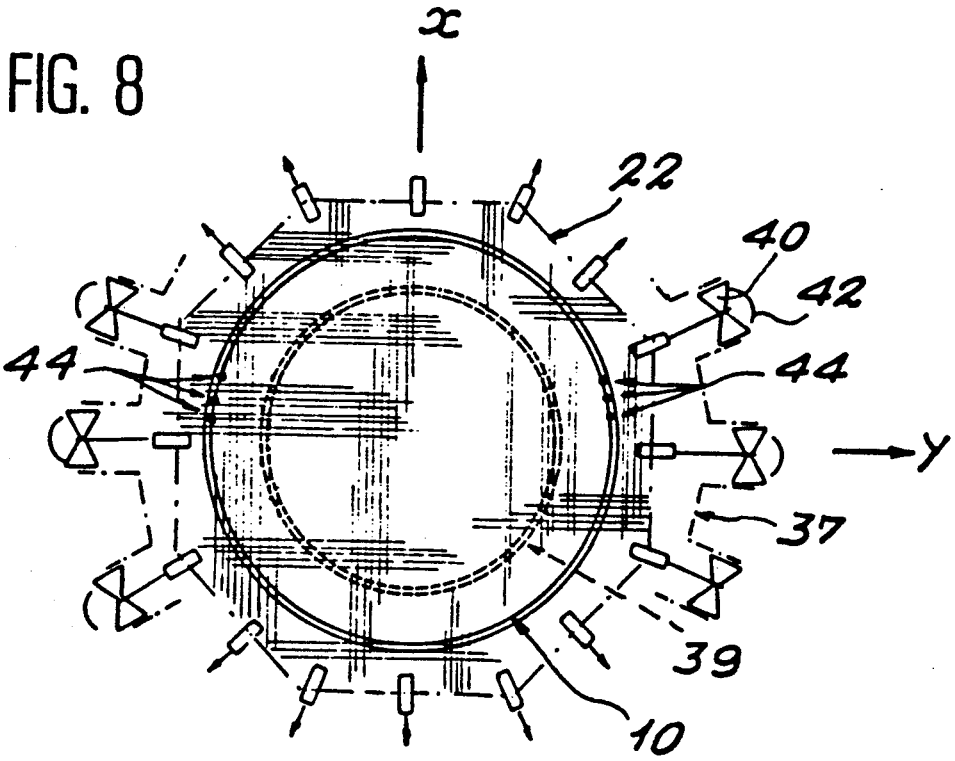
FIG. 8 is a plan view diagrammatically illustrating the mounting of the fabric onto the support of the reflector of the invention.

With reference with FIGS. 7 and 8, there now follows a description of the placing of the fabric 22 on the rigid painted support 10.

The mounting of the fabric 22 on the support 10 is effected after having glued the section 26 of the hook and loop strip equipped with its pins at the periphery of the lower face 20*a* of the support, as well as the adhesive "Katpon®" 32 on the edge of the support. The reflector is then centered on the mobile board 37 of a tensioned table 38 by means of a cylindrical support 39. This positioning is effected so that the surface tangent to the surface 10*a* of the reflector passes above tensioned rollers 40.

After having placed the fabric 22 on the painted active face 10*a* of the reflector, said fabric stretches via the hooking of weights 42 weighing about 40 g distributed roughly every 40 mm apart over the entire periphery of the reflector (FIG. 8) so as to obtain, in the chain and width direction respectively marked x and y, a tension of 120 Newtons per meter.

After loading, the entire unit is vibrated so as to homogeneously distribute the tensions. So as to immobilize the stretched fabric, needles 44 are disposed at the periphery of the reflector 10. As shown on FIG. 4, these needles are threaded between the edge 33 of the support 10 and the adhesive "Kapton®" 32. These needles solely traverse the fabric 22. They are disposed at a pitch of about 4 mm.

With the aid of a curved needle and a thread with a composition differing from that of the fabric 22 (cotton or "Kevlar®"), an overcasting 46 of the fabric is carried out at a distance e from the periphery of the support 10 and thus from the needles 44, which is equal to the thickness of the support 10 (in particular 25 mm).

Then the tensioned weights are unhooked, the needles 44 ensuring that the fabric is maintained on the support 10 and the overcasting 46 making it possible to refind the tension of the fabric 22 when the fabric is secured to the hook and loop fastener.

Then the fabric 22 is folded down onto the edge 33 of the reflector (in other words onto the adhesive "Kapton®"32) and then onto the periphery of the lower face 20*a* of the reflector; the non-overcast section 22*a* of the fabric is then hooked onto the pins 28 of the section 26 of the hook and loop strip. Then the felt section 30 of the hook and loop fastener is applied to the section 26.

The entire unit obtained is then no longer able to be disassembled, the fabric being definitively held in place by the hook and loop fastener strips by means of the pins 28.

The whole fabric is then cut flush with the hook and loop strip (FIG. 4) so as to avoid the fabric from going past the hook and loop strip. It is then possible to remove the holding needles 44. Then the extra-insulation material 35 is secured to the rear face of the reflector. The reflector is then finished.

Temperature rise and fall tests between −160° C. and −100° C. in an empty solar caisson over extended periods having confirmed the sound thermal behaviour of the reflector. Moreover, radioelectric tests on flat test pieces representative of the reflector have confirmed the sought-after radioelectric properties of the reflector.

What is claimed is:

1. A method for producing a radio electromagnetic wave reflector of the type comprising a rigid curved support provided with a convex active front face and a rear face, a dielectric and heat-insulating paint coating the support front face, a stretched electrical conductive knitting for reflecting an electromagnetic wave and covering the heat-insulating paint, said knitting comprising a convex active face of the reflector and having a mesh diameter of less than $\lambda/8$, and means for securing the knitting to the support, the steps of:

(a) mounting the securing means to the support rear face, (b) placing on the support front face over the heat-insulating paint a knitting whose size is larger than that of the front face, (c) stretching said knitting over the entire periphery of the reflector and implanting needles in the stretched knitting at the periphery of the support, (d) stretching the knitting at a specific distance from the needles and outside the support so that it overcasts said support, (e) folding down a non-overcast knitting section onto the rear face of the support, (f) securing said non-overcast knitting section onto the support rear face with the aid of said securing means, and (g) removing the needles.

2. The method according to claim 1, and including the step of stretching the knitting so that the distance separating the overcasting and the needles is equal to the thickness of the support provided with the heat-insulating paint.

3. The method according to claim 1, wherein the knitting comprises molybdenum coated with gold.

4. The method according to claim 1, and including the step of sandwiching a honeycomb-shaped structure between a first coating comprising the front face and a second coating comprising the rear face to form the support.

5. The method according to claim 1, and including the step of providing an additional heat-insulating means on the rear face of the support.

6. The method according to claim 5, wherein the additional insulating means comprise alternating metallized layers and insulating layers.

7. The method according to claim 6, wherein the insulating layers comprise fabric gauzes.

8. The method according to claim 1, wherein the securing means comprises a strip adhesively mounted on the rear face, said strip comprising a first section provided with picots and a second section for adhering to the first section, and including the step of inserting an edge of the knitting between the first and second sections.

9. The method according to claim 8, and including the step of adhesively holding the additional heat-insulating means on the support.

* * * * *